US007824210B2

(12) United States Patent
Oka et al.

(10) Patent No.: US 7,824,210 B2
(45) Date of Patent: Nov. 2, 2010

(54) CONNECTOR

(75) Inventors: Taichi Oka, Hitachi (JP); Koichi Kato, Hitachi (JP); Hideaki Takehara, Hitachi (JP); Sachio Suzuki, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 12/457,150

(22) Filed: Jun. 2, 2009

(65) Prior Publication Data

US 2010/0120284 A1 May 13, 2010

(30) Foreign Application Priority Data

Nov. 10, 2008 (JP) ..... 2008-287269

(51) Int. Cl.
*H01R 13/64* (2006.01)

(52) U.S. Cl. ..... 439/372

(58) Field of Classification Search ..... 439/372, 439/392, 607.14, 680, 627, 352
See application file for complete search history.

(56) References Cited

U.S. PATENT DOCUMENTS

| | | | | |
|---|---|---|---|---|
| 4,310,213 | A * | 1/1982 | Fetterolf et al. | 439/320 |
| 4,611,878 | A * | 9/1986 | Hall et al. | 439/607.47 |
| 4,723,916 | A * | 2/1988 | Fusselman et al. | 439/92 |
| 4,737,124 | A * | 4/1988 | Ezure et al. | 439/607.41 |
| 4,960,389 | A * | 10/1990 | Frantz et al. | 439/404 |
| 6,113,436 | A | 9/2000 | Kuwahara et al. | |
| 6,942,516 | B2 * | 9/2005 | Shimoyama et al. | 439/352 |
| 2002/0072275 | A1 * | 6/2002 | Arai | 439/680 |
| 2008/0102710 | A1 | 5/2008 | Sato | |
| 2009/0042447 | A1 | 2/2009 | Sato | |

FOREIGN PATENT DOCUMENTS

| | | |
|---|---|---|
| EP | 0 951 099 A2 | 10/1999 |
| JP | 63-190269 | 8/1988 |
| JP | 2000-3750 | 1/2000 |
| JP | 2008-108675 | 5/2008 |

* cited by examiner

*Primary Examiner*—Jean F Duverne
(74) *Attorney, Agent, or Firm*—McGinn IP Law Group PLLC

(57) ABSTRACT

A connector includes a male connector part composed of a male terminal, a first main body to which the male terminal is attached, and a first terminal housing portion composed of a first housing opening portion in which an end of the male terminal is exhibited and a predetermined housing space in which the male terminal is housed, a female connector part composed of a female terminal into which the male terminal is inserted, the male terminal being electrically connected to the female terminal by fitting the male connector part with the female connector part, a holding means inside the female terminal for holding the male terminal in a vertical direction, and a touch protecting means inside the first terminal housing portion for protecting the male terminal housed in the predetermined housing space from being touched by a foreign body. The touch protecting means includes an insulating portion for covering a part of the male terminal including the end of the male terminal except a part contacting the holding means when the male terminal is inserted into the female terminal, and a pair of projecting portions projecting in the predetermined housing space of the first terminal housing portion and at a position opposite the part contacting the holding means when the male terminal is inserted into the female terminal such that the male terminal is sandwiched therebetween in the vertical direction.

14 Claims, 14 Drawing Sheets

5 MALE TERMINAL
13 FIRST TERMINAL HOUSING PORTION
14 FIRST MAIN BODY
15 FIRST HOUSING OPENING PORTION
29 PROJECTING PORTION
30 OPPOSED SURFACE

5 MALE TERMINAL
13 FIRST TERMINAL HOUSING PORTION
14 FIRST MAIN BODY
15 FIRST HOUSING OPNING PORTION
26 RUBBER CAP
29 PROJECTING PORTION
30 OPPOSED SURFACE

14 FIRST MAIN BODY
15 FIRST HOUSING OPENING PORTION
26 RUBBER CAP

13 FIRST TERMINAL HOUSING PORTION
14 FIRST MAIN BODY
29 PROJECTING PORTION

5 MALE TERMINAL
23 SIDEWELL PORTION
24 BOTTOM PORTION
25 CONCAVE PORTION

13 FIRST TERMINAL HOUSING PORTION
26 RUBBER CAP
29 PROJECTING PORTION
39 OPPOSED SURFACE

5 MALE TERMINAL
6 FEMALE TERMINAL
24 BOTTOM PORTION
26 RUBBER CAP
31 PROTRUSION
32 SPRING PORTION
33 DIMPLE PORTION

29 PROJECTING PORTION
39 OPPOSED SURFACE
45 COVER PORTION

5 MALE TERMINAL
23 SIDEWALL PORTION
24 BOTTOM PORTION
46 CONCAVE PORTION

CONNECTOR

The present application is based on Japanese patent application No. 2008-287269 filed Nov. 10, 2008, the entire contents of which are incorporated herein by reference.

BACKGROUND OF THE INVENTION

1. Field of the Invention

This invention relates to a connector used in hybrid vehicles, electric vehicles etc. and, particularly, a connector to be used in a wire harness for carrying large amount of power, and relates to so-called "touch protect" technology that a male terminal of a male connector can be protected from being directly touched by a foreign body such as a hand and a finger.

2. Description of the Related Art

In hybrid vehicles, electric vehicles etc. achieving a remarkable improvement in recent years, a high-power harness used for connection between a motor and an inverter, or the inverter and a battery to carry large amount of power has a two-fraction connector composed of a male connector having male terminals and a first terminal housing for housing the male terminals, and a female connector having female terminals to be connected to the male terminals and a second terminal housing for housing the female terminals, which are provided at ends of the high-power harness.

Thus far, so-called "touch protect" technology is known that the male terminals of a male connector can be protected from being directly touched by a foreign body such as a hand and a finger.

The technology is disclosed in JP-A-2008-108675, JP-A-2000-3750, JP-A-S63-190269 etc.

The technology disclosed by the above patent literatures relates to a connector with an insulator disposed at a top end thereof, but has problems below.

The problem is caused when the male terminal is inserted into the female terminal. For example, upon the insertion, the insulator at the top end of the male terminal may contact a protrusion at a dimple portion for electrical contact in the female terminal, or a spring portion for pushing the male terminal against the dimple portion for electrical contact in the female terminal. Thereby, the insertion force of the male terminal may increase that is needed for inserting the male terminal into the female terminal.

Thus, the insertion performance of the male terminal into the female terminal may lower. Also, another problem may be caused that the insulator is worn by the contact therebetween.

SUMMARY OF THE INVENTION

Therefore, it is an object of the invention to provide a connector which can protect the male terminal from being directly touched by a foreign body such as a hand and a finger without reducing the insertion performance of the male terminal into the female terminal.

(1) According to one embodiment of the invention, a connector comprises:

a male connector part comprising a male terminal, a first main body to which the male terminal is attached, and a first terminal housing portion comprising a first housing opening portion in which an end of the male terminal is exhibited and a predetermined housing space in which the male terminal is housed;

a female connector part comprising a female terminal into which the male terminal is inserted, the male terminal being electrically connected to the female terminal by fitting the male connector part with the female connector part;

a holding means inside the female terminal for holding the male terminal in a vertical direction; and a touch protecting means inside the first terminal housing portion for protecting the male terminal housed in the predetermined housing space from being touched by a foreign body, wherein the touch protecting means comprises an insulating portion for covering a part of the male terminal including the end of the male terminal except a part contacting the holding means when the male terminal is inserted into the female terminal, and a pair of projecting portions projecting in the predetermined housing space of the first terminal housing portion and at a position opposite the part contacting the holding means when the male terminal is inserted into the female terminal such that the male terminal is sandwiched therebetween in the vertical direction.

(2) According to another embodiment of the invention, a connector comprises:

a male connector part comprising a male terminal, a first main body to which the male terminal is attached, and a first terminal housing portion comprising a first housing opening portion in which an end of the male terminal is exhibited and a predetermined housing space in which the male terminal is housed;

a female connector part comprising a female terminal into which the male terminal is inserted, the male terminal being electrically connected to the female terminal by fitting the male connector part with the female connector part;

a holding means inside the female terminal for holding the male terminals in a vertical direction; and a touch protecting means inside the first terminal housing portion for protecting the male terminal housed in the predetermined housing space from being touched by a foreign body, wherein the predetermined housing space has such a width in the vertical direction that a part of the male terminal contacting the holding means when the male terminal is inserted into the female terminal can be protected from being touched by the foreign body, and the touch protecting means comprises an insulating portion for covering a part of the male terminal including the end of the male terminal except the part contacting the holding means when the male terminal is inserted into the female terminal.

(3) According to another embodiment of the invention, a connector comprises:

a male connector part comprising a male terminal, a first main body to which the male terminal is attached, and a first terminal housing portion comprising a first housing opening portion in which an end of the male terminal is exhibited and a predetermined housing space in which the male terminal is housed;

a female connector part comprising a female terminal into which the male terminal is inserted, the male terminal being electrically connected to the female terminal by fitting the male connector part with the female connector part;

a holding means inside the female terminal for holding the male terminals in a vertical direction; and a touch protecting means inside the first terminal housing portion for protecting the male terminal housed in the predetermined housing space from being touched by a foreign body, wherein the predetermined housing space has such a width in the vertical direction that a part of the male terminal contacting the holding means when the male terminal is inserted into the female terminal can be protected from being touched by the foreign body, the touch protecting means comprises an insulating portion for covering a part of the male terminal including the end of the male terminal except the part contacting the holding means when the male terminal is inserted into the female terminal, and the touch protecting means further comprises a projecting portion projecting in the predetermined housing space of the first terminal housing portion and at a position opposite the part contacting the holding means when the male terminal is inserted into the female terminal.

In the above embodiments (1) to (3), the following modifications and changes can be made.

(i) The insulating portion at the end of the male terminal projects a predetermined amount from the part contacting the holding means when the male terminal is inserted into the female terminal.

(ii) The male terminal is nearly U-shaped in a cross section, and comprises a pair of sidewall portions and a bottom portion contacting the holding means, and the insulating portion covers a front surface, an outside surface, an upper surface and a bottom surface of the sidewall portions of the male terminal, and a front end of the pair of sidewall portions covered with the insulating portion projects a predetermined amount from a front end of the bottom portion.

(iii) The bottom portion comprises a concave portion formed at an end potion thereof.

(iv) The projecting portion has substantially a same width in a horizontal direction as that of the male terminal covered with the insulating portion.

Points of the Invention

A connector of the invention uses (A) a predetermined housing space having such a width in the vertical direction that a part of the male terminal contacting the holding means when the male terminal is inserted into the female terminal can be protected from being touched by the foreign body, and/or (B) a touch protecting means composed of (B1) an insulating portion for covering a part of the male terminal including the end of the male terminal except the part contacting the holding means when the male terminal is inserted into the female terminal, and/or (B2) a projecting portion projecting in the predetermined housing space of the first terminal housing portion and at a position opposite the part contacting the holding means when the male terminal is inserted into the female terminal, in order to protect the male terminal from being directly touched by a foreign body such as a hand and a finger without reducing the insertion performance of the male terminal into the female terminal.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First Embodiment

Hereinafter, a connector according to a first embodiment will be explained with reference to FIGS. 1 to 10.

Figure 1:
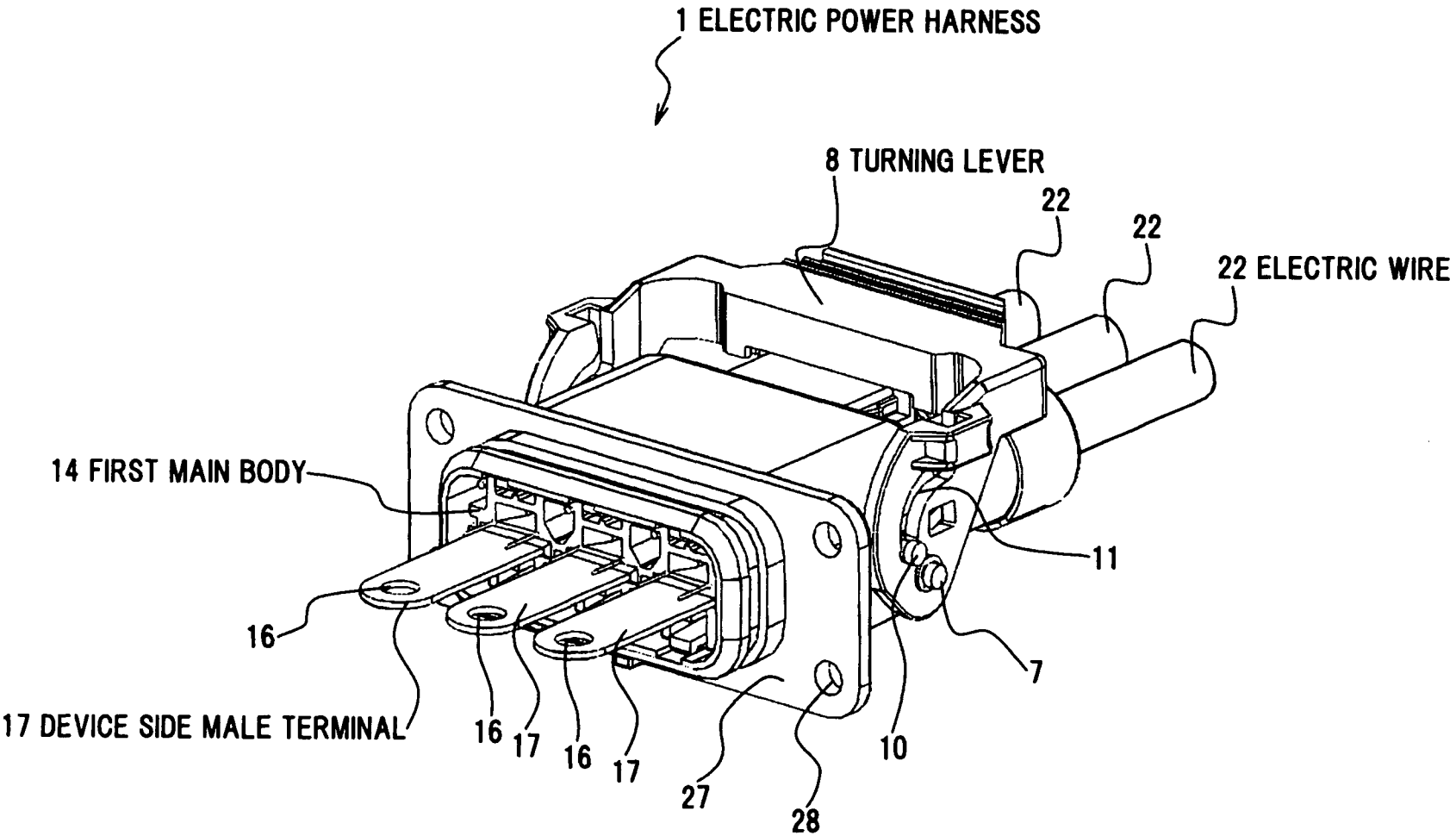
FIG. 1 is a perspective view schematically showing a power harness equipped with a connector in a first embodiment according to the invention.
Figure 2:
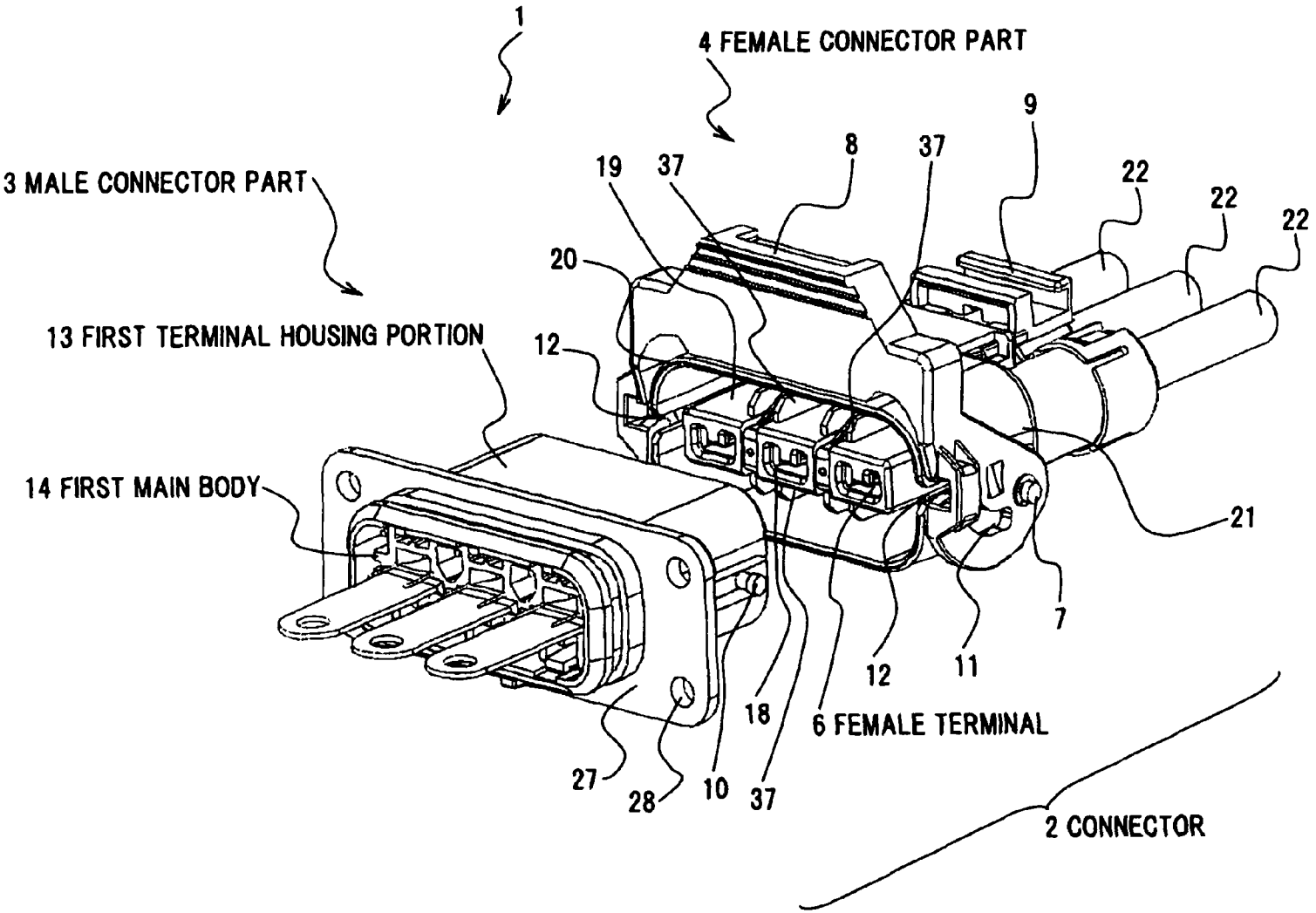
FIG. 2 is an explanatory view schematically showing a state that a male connector portion and a female connector portion are separated in the connector of the first embodiment according to the invention.

As shown in FIGS. 1 and 2, a connector 2 in the first embodiment according to the invention is mounted on at least one side of an electric power harness 1, and if a male connector part 3 and a female connector part 4 are fitted (a mode shown in FIG. 1). a male terminal 5 and a female terminal 6 paired with the male terminal 5 installed in housing spaces of the respective connector parts 3, 4 are electrically connected respectively.

Further, the electric power harness 1 is used for connecting a motor and an inverter which drive HEV (Hybrid Electric Vehicle), the HEV being capable of reducing poisonous gas emissions and fuel consumption drastically, such a large amount of current as not less than 100 A is applied in some HEV system.

Then, a switching between a fit mode that the male connector part 3 and the female connector part 4 are fitted (a mode shown in FIG. 1) and a non-fit mode that they are not fitted (a mode shown in FIG. 2), namely, the switching corresponds to a removal of the male connector part 3 from the female connector part 4 and it also corresponds to the removal of the female connector part 4 from the male connector part 3, is carried out by a turning lever 8 to turn around a pivot 7 installed in both sides of the female connector part 4.

If the turning lever 8 is positioned in the mode shown in FIG. 1, namely, is located in a lock portion 9, the male connector part 3 and the female connector part 4 is positioned in the fit mode, on the other hand, the turning lever 8 is dislocated from the mode shown in FIG. 1, namely, is dislocated from the lock portion 9, the male connector part 3 and the female connector part 4 is positioned in the non-fit mode. Further, the operation mechanism according to the turning lever 8 can be achieved by the pivot 7, slide axes 10 installed in both sides of the male connector part 3, carved slide holes 11 installed in both sides of the turning lever 8 and straight slide holes 12 installed in both sides of the female connector part 4. Then, the male connector part 3 is attracted to the female connector part 4 due to the turning lever 8, so that the fit mode (the mode shown in FIG. 1) of the male connector part 3 and the female connector part 4 can be easily achieved. Further, the fit mode can provide the connector 2 with an advantage of waterproof function.

Next, the male connector part 3 will be explained.

Figure 3:
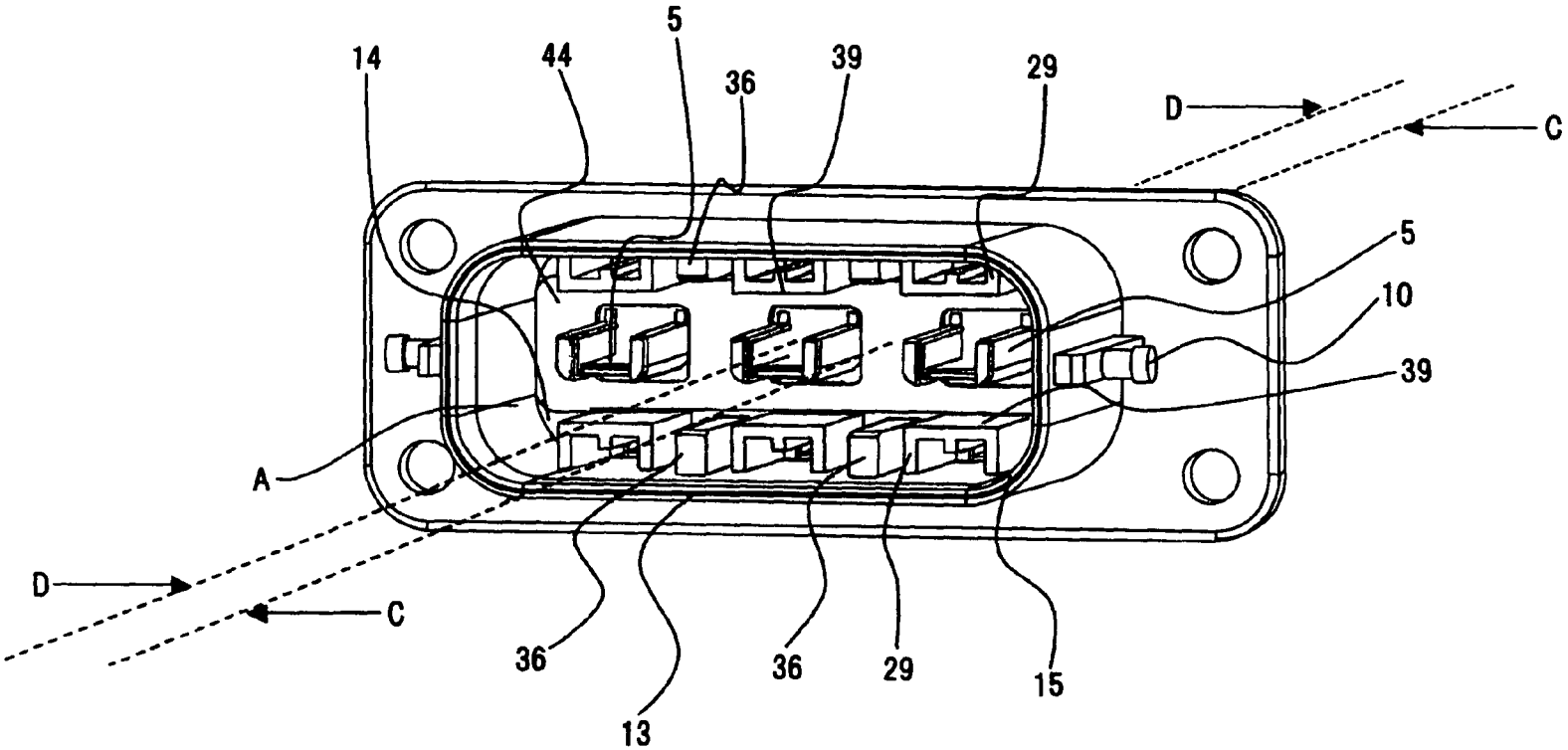
FIG. 3 is an explanatory view schematically showing an inside of a first terminal housing of the male connector portion in the connector of the first embodiment according to the invention.

As shown in FIGS. 1 to 3, the male connector part 3 includes the three (3-prong) male terminals 5 arranged substantially linearly, a first main body 14 made from resin, in which the three male terminals 5 are installed, and the body 14 being housed in a predetermined housing space A of a first terminal housing portion 13 described below, and the first terminal housing portion 13 which has a first housing opening portion 15 to which the top end portions of the three male terminals 5 face, for housing the three male terminals 5 and the first main body 14 in the predetermined housing space A.

Figure 8:
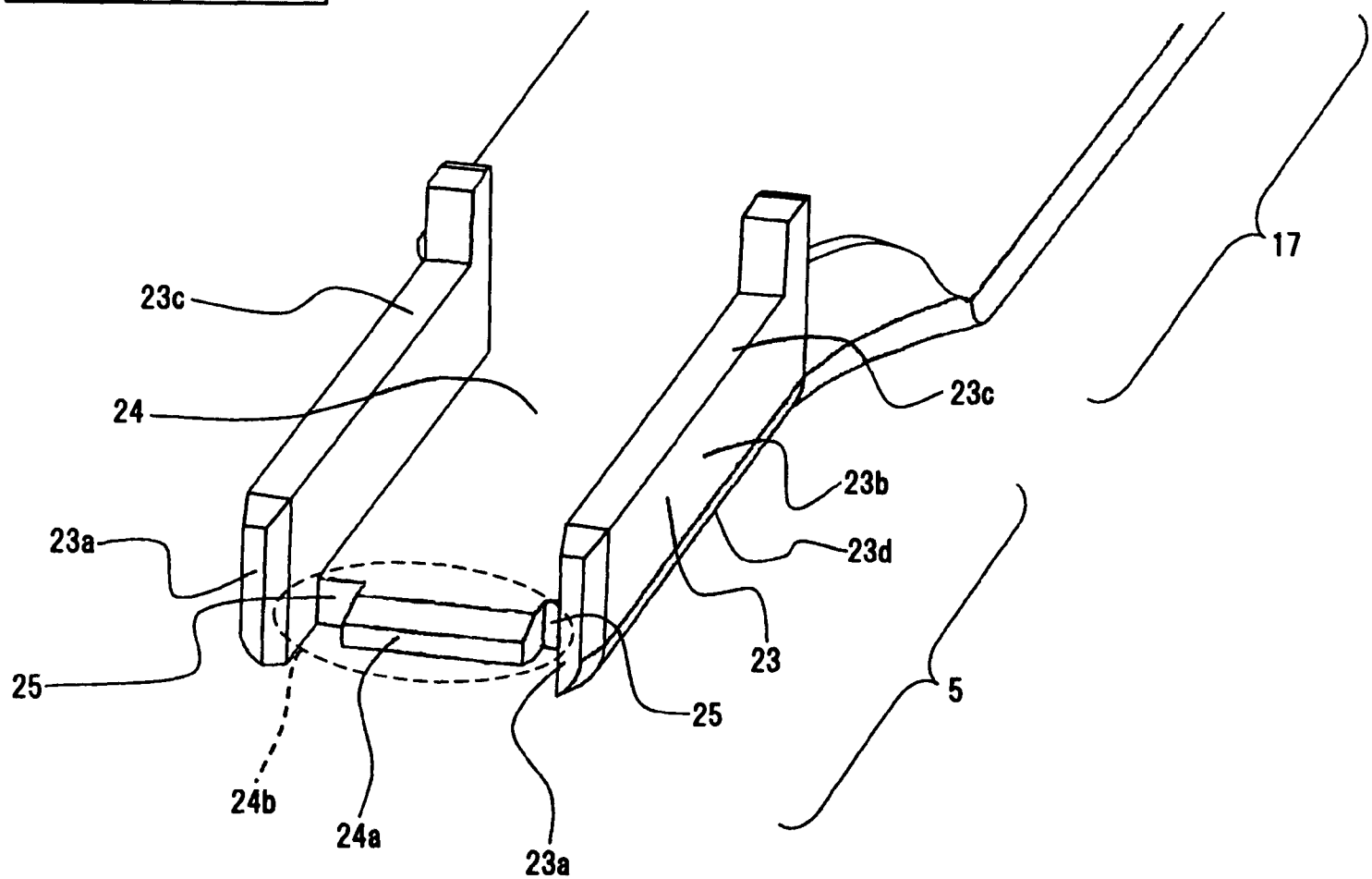
FIG. 8 is an explanatory view schematically showing that the male terminal and a device side male terminal are integrally formed in the connector of the first embodiment according to the invention.

Further, each of the three male terminal 5 is configured to have a structure that the one top end portion faces to the first housing opening portion 15, and the other top end portion is connected to a device side male terminal 17 of a plate-like shape in which a device connection hole 16 of a round shape is formed, the hole 16 being used for engaging with a device side projection portion (not shown) (actually, the male terminal 5 and the device side male terminal 17 are integrally formed from the same material: see FIG. 8). Further, in the embodiment, the device side male terminal 17 is connected to the inverter side.

Then, as shown in FIG. 8, the male terminal 5 to be inserted into the female terminal 6 is formed to have a roughly U-shaped cross-section and includes a pair of sidewall portions 23 and a bottom portion 24 to contact a holding means of the female terminal 6 described below. This is designed to increase the cross-section area and the surface area, and contributes to reduction of heat generation and enhancement of heat radiation when applying current. Further, this also provides an advantage of preventing the first main body 14 made of resin in which the male terminals 5 are installed from being damaged and being transformed. Furthermore, the sidewall portions 23 are formed in the locations that keep away from paths to contact the holding means described below according to a planar view.

Further, the male terminal 5 formed to have a roughly U-shaped cross-section is configured to have a structure that front surfaces 23*a* of a pair of the sidewall portions 23 are located in advance of a front surface 24*a* of the bottom portion 24, as shown in FIG. 8, just like the end portion including the front surfaces 23*a* of a pair of the sidewall portions 23 projects. Further, in both ends of an end portion 24*b* of the bottom portion 24, a concave portion 25 is respectively formed. Due to this, a rubber cap 26 described below can be easily hooked. Further, a pair of the sidewall portions 23 has an interval corresponding to a gap into which fingers cannot be inserted.

Further, the first terminal housing portion 13 is made of metal, such as aluminum, the internal space thereof forms the predetermined housing space A. Further, in the embodiment, the predetermined housing space A means an internal space from the end portion side of the first main body 14 to the first housing opening portion 15. And, as shown in FIG. 3, in the first terminal housing portion 13, guide pieces 36 are installed, guide pieces 36 projecting toward the inside of the predetermined housing space A, between projecting portions 29 described below or the male terminals 5. The guide pieces 36 are configured to engage with guide grooves 37 (see FIG. 2) installed in a housing space of the female connector part 4 so that the male terminal 5 and the female terminal 6 can be smoothly connected.

Then, a mounting plate 27 is installed on an exterior surface located in a side being near the device side male terminal 17 of the first terminal housing portion 13. Further, in four corners of the mounting plate 27 mounting holes 28 are formed, which can be used when mounted on the device.

Further, in the embodiment, the first main body 14 which is made from insulating resin and is wholly built into the first terminal housing portion 13 has been explained, but the body 14 not being built into the portion 13 can be also used. In other words, for example, the first main body 14 can be installed as the first terminal housing portion 13 covers the end portion constituting a part of the first main body 14. However, if the composition is adopted, it is preferable that a part corresponding to the mounting plate 27 in the embodiment is formed in the side of the first main body 14.

The first main body 14 is made from resin and fabricated by an insert molding method including steps of inserting insert articles (the male terminal 5 and the device side male terminal 17) into a molding, injecting resin in order that the insert articles are wrapped with molten resin, and then solidifying and integrating the insert articles.

In the first main body 14, projecting portions 29 constituting a part of a touch protecting means described below are respectively formed, the projecting portions 29 being located in the upper and lower directions of the male terminal 5, contacting the upper and lower surfaces of the bottom portion 24 of the male terminal 5 and projecting so as to sandwich the male terminal 5 from above and below.

The main points of the invention, the touch protecting means will be explained below.

The touch protecting means comprises rubber caps 26 as insulating portions for covering a part of the male terminal 5 with the exception of parts which contact the holding means described below when the male terminals 5 are inserted into the female terminals 6, including a predetermined region at least from a part facing to the first housing opening portion 15 to the first main body 14 with insulators, and projecting portions 29 installed so as to project in the predetermined housing space A of the first terminal housing portion 13, at the locations opposed to the parts contacting the holding means described below (particularly, the upper and lower surfaces of the bottom portion 24 of the male terminal 5) when the male terminals 5 are inserted into the female terminals 6, and in a state of holding (sandwiching) the male terminals 5 from above and below.

Further, in the embodiment, the predetermined region covered with the rubber caps 26 is defined as a region from the front surfaces 23*a* of the sidewall portions 23 of the male terminal 5 (refer to FIG. 8) to places against which the first main body 14 butts. However, the region does not limited to the above, and if it is a region where the same effect as that of the invention can be provided, the other embodiments can be also used. Namely, a region shorter than the rubber cap 26 of the first embodiment can be also used. In sum, it may be sufficient that at least top portions of the male terminal 5 are covered.

The projecting portions 29 are installed in the first main body 14 corresponding to each of the male terminals 5 so as to extend from the first main body 14 to the first housing opening portion 15 and along the internal surface of the first terminal housing portion 13. Further, as shown in FIG. 3, the projecting portions 29 are formed to have a roughly U-shaped cross-section and are respectively configured to have a structure that the opening side of the U-shaped cross-section is covered with the first terminal housing portion 13. And, opposed surfaces 39 opposed to the male terminal 5, the surfaces 39 constituting a part of the male terminal 5, are arranged roughly parallel to the bottom portion 24 of the male terminal 5 so as to cover the bottom portion 24 of the male terminal 5.

Figure 5:
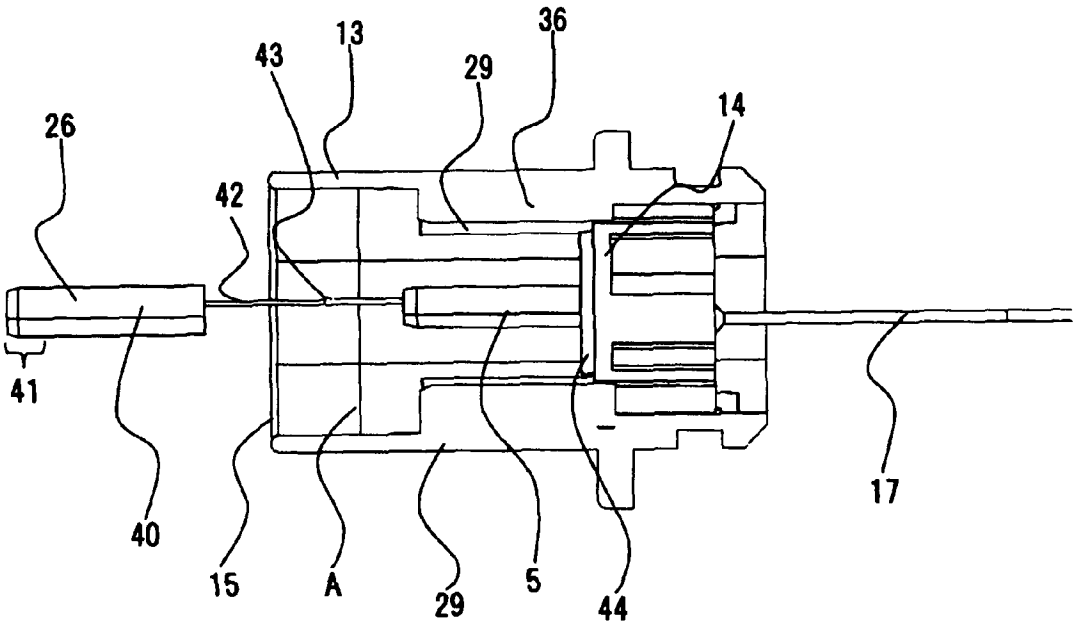
FIG. 5 is a cross-sectional view taken along the line B-B in FIG. 4 in the connector of the first embodiment according to the invention.
Figure 6:
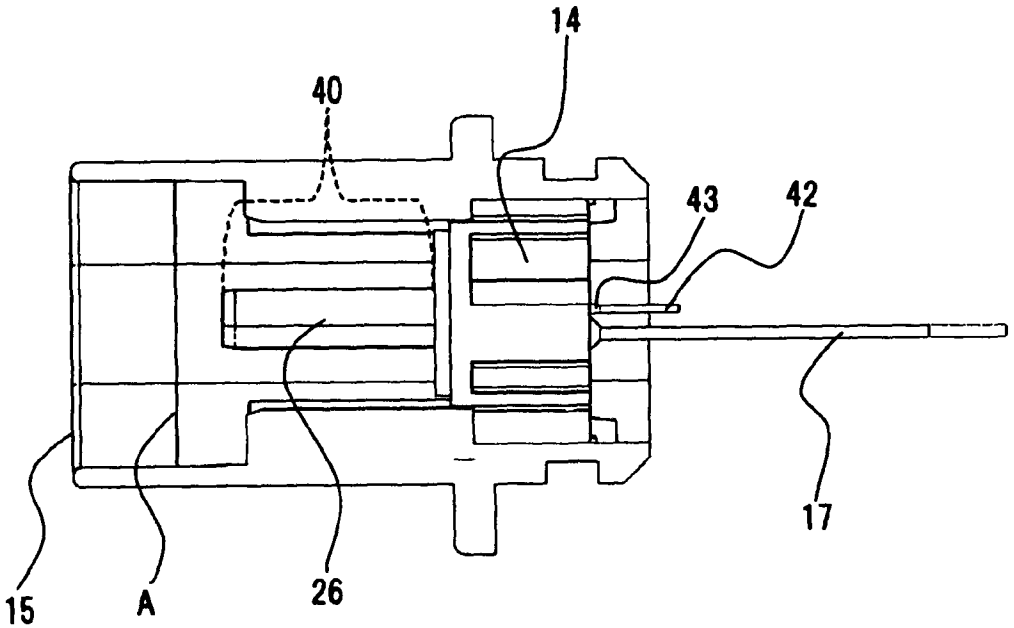
FIG. 6 is a cross-sectional view taken along the line C-C in FIG. 3 in the connector of the first embodiment according to the invention.
Figure 7:
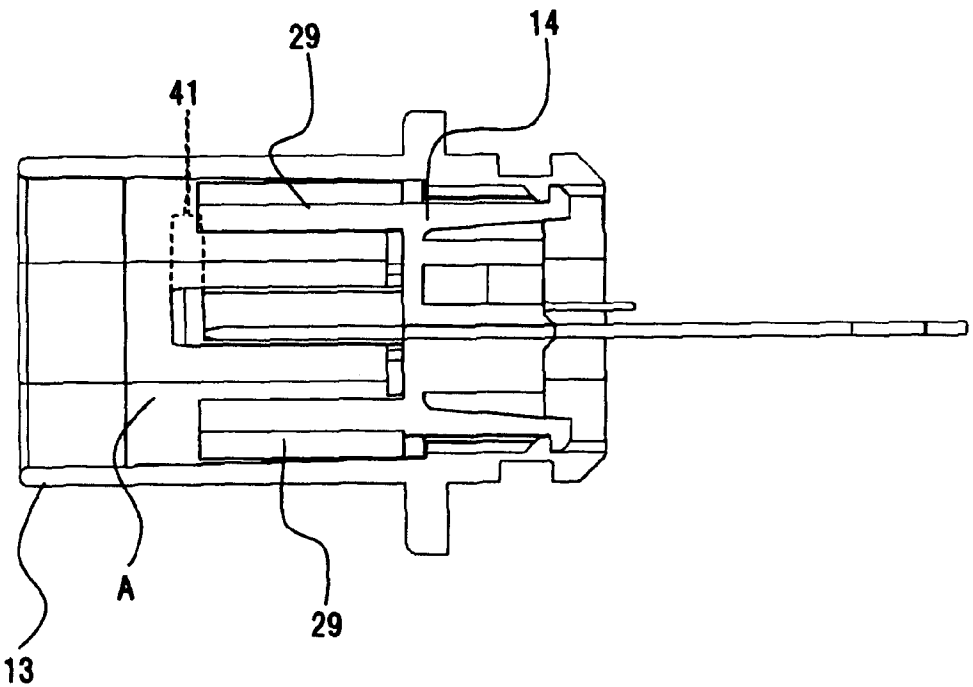
FIG. 7 is a cross-sectional view taken along the line D-D in FIG. 3 in the connector of the first embodiment according to the invention.

Further, the top portions of the projecting portions 29, particularly, as shown in FIG. 5, the front surfaces of the end thereof in the side of the first housing opening portion 15 are located in nearly the same line with the top portion of the male terminal 5 according to a side view. More precisely, they are arranged so as to be located in nearly the same line with the front surface 24*a* of the bottom portion 24 of the male terminal 5.

Figure 9:
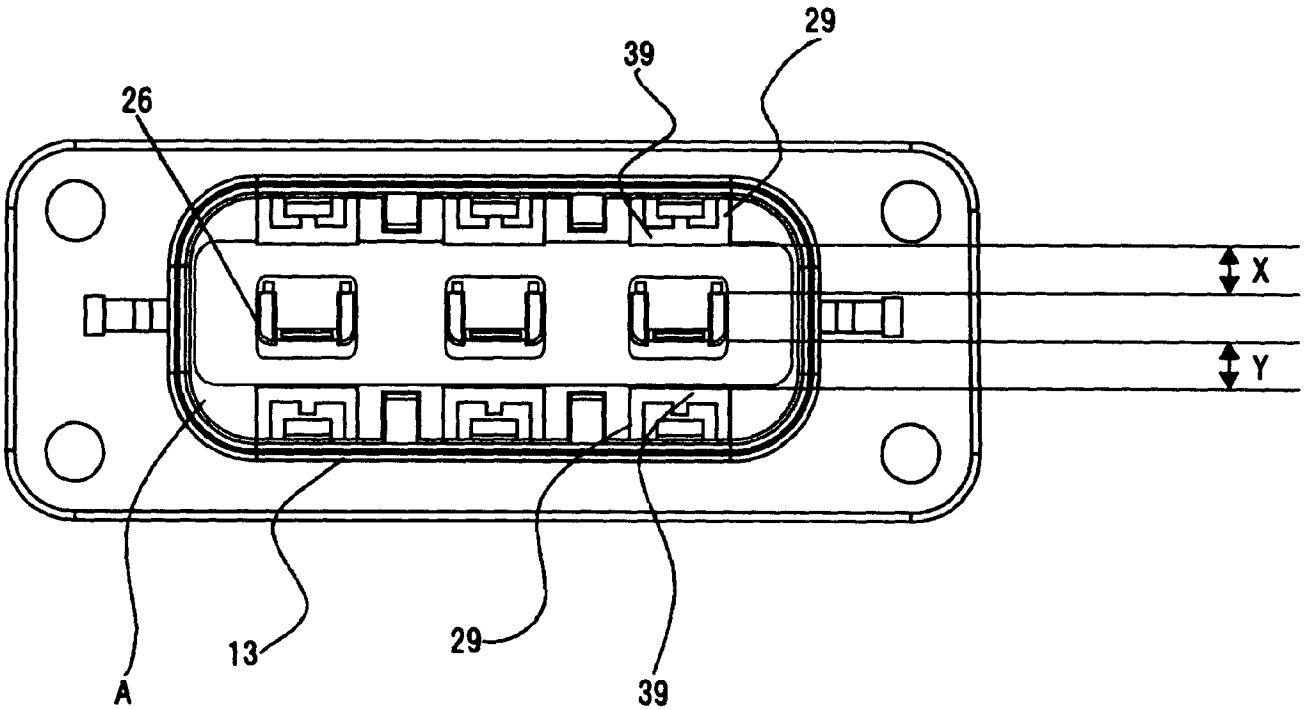
FIG. 9 is a front view schematically showing the inside of the first terminal housing of the male connector portion in the connector of the first embodiment according to the invention.

Further, as shown in FIG. 9, the opposed surfaces 39 of the projecting portions 29 are arranged so as to be a predetermined distance (X, Y) away from the male terminal 5 to which the rubber cap 26 is applied. Furthermore, the predetermined distance means that adult fingers cannot be inserted into a space formed between the male terminal 5 to which the rubber cap 26 is applied and the opposed surfaces 39 of the projecting portions 29, even if the fingers are laid transversely. Particularly, it is almost 5 to 7 mm.

Further, as shown in FIG. 9, the opposed surface 39 of the projecting portion 29 has substantially the same width in the horizontal direction as that of the male terminal 5 in a front view. Namely, they are configured to be opposed to both of the upper and lower surfaces of the rubber cap 26 applied to the sidewall portions 23. This structure is capable of protecting the male terminal 5 to which the rubber cap 26 is not applied from directly being touched by a foreign body such as a hand and a finger.

Figure 4:
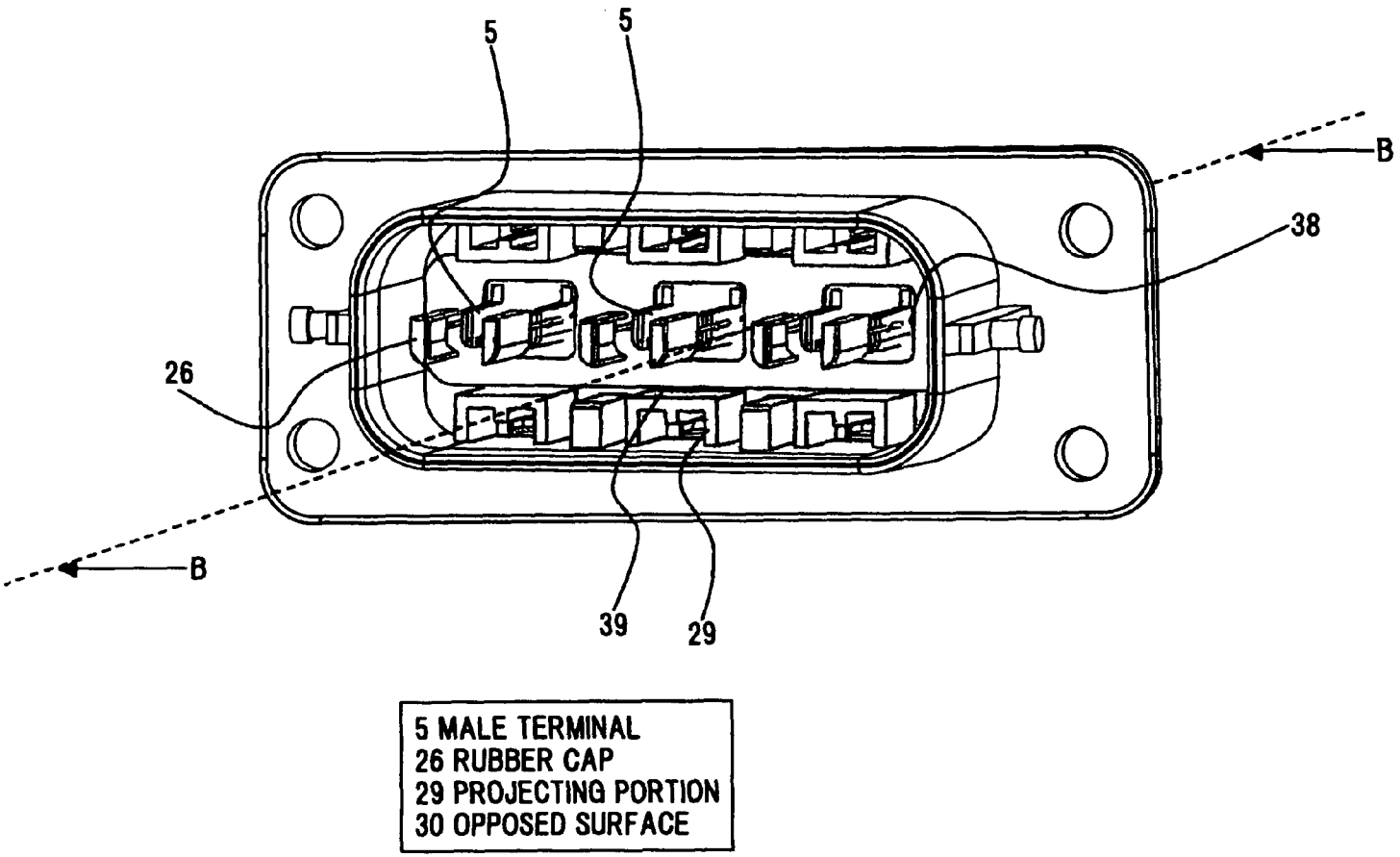
FIG. 4 is an explanatory view schematically showing a state that the top end portion of the male terminals are going to be covered with rubber caps in the connector of the first embodiment according to the invention.

Then, as shown in FIGS. 3 and 4, the rubber cap 26 is applied to the male terminal 5, the rubber cap 26 being an insulating portion for covering a part of the male terminal 5 facing to the first housing opening portion 15 with an insulating material. Particularly, the rubber cap 26 covers the top portion of the male terminal 5 which constitutes a part of the end portion of the male terminal 5 in the insertion side and includes the front surface 23*a* of the sidewall portion 23 of the male terminal 5, and further, the rubber cap 26 covers the external side surface 23*b*, the upper surface 23*c*, the lower surface 23*d* other than the top portion (see FIGS. 6 to 9).

As shown in FIGS. 4 to 7, the rubber cap 26 includes at least a cap main body 40 extending in the longitudinal direction similarly to the male terminal 5, a pocket portion 41 formed in one end of the cap main body 40 and covering the whole of the top portion of the male terminal 5 and a lead wire 42 installed in the opposite side to the pocket portion 41 and in another end of the cap main body 40.

Further, the rubber cap 26 covers predetermined regions of the front surfaces 23*a* of the pair of sidewall portions 23, the external side surface 23*b*, the upper surface 23*c* and the lower surface 23*d* of the male terminal 5, at least including regions from a part facing to the first housing opening portion 15 to the first main body 14, and further, the front surfaces 23*a* of the pair of sidewall portions 23 covered with the rubber caps 26 are more outstanding than the front surface 24*a* of the bottom portion 24 of the male terminal 5 in a predetermined amount. Further, in the embodiment, the predetermined amount has been appropriately designed in view of shape of finger.

This structure is capable of protecting the front surface 24*a* of the bottom portion 24 of the male terminal 5 from being touched by a foreign body such as a hand, a finger even if the front surface 24*a* of the bottom portion 24 of the male terminal 5 is not covered with the rubber cap 26.

Hereinafter, an operation of applying the rubber cap 26 to the male terminal 5 will be explained with reference to FIGS. 3 to 6.

The top portion of the male terminal 5 is covered with the pocket portion 41 of the rubber cap 26, the one end portion of the lead wire 42 is passed into a hole 38 formed in a predetermined location of the first main body 14 and the one end portion of the lead wire 42 is pulled out from the opposite side of the first main body 14. And, the one end portion of the lead wire 42 pulled out of the hole 38 in the opposite side is further pulled, and it is stopped to pull the lead wire 42 when an engaging portion 43 formed in a predetermined location of the lead wire 42 is pulled out of the hole 38 in the opposite side. And then, a state that the rubber cap 26 is pulled by the top portion of the male terminal 5 is caused, so as to complete the operation of applying the rubber cap 26 to the male terminal 5. Further, in the state that the applying operation is completed, the one end portion of the lead wire 42 which protrudes from the first main body 14 and becomes unnecessary can be cut if needed.

To the first main body 14, a vibration absorption mat 44 for absorbing vibration is attached. This can prevent the male connector part 3 and the female connector part 4 from jouncing in the fitting part therebetween. Namely, this contributes to enhancement of stability of the fitting condition.

Next, the female connector part 4 will be explained.

As shown in FIG. 2, the female connector part 4 at least includes three female terminals 6 paired with the three male terminals 5, female terminal boxes 19 configured to have female terminal opening portion 18 to which the end portions of the three female terminals 6 face respectively and simultaneously to house the three female terminals 6 into predetermined housing spaces respectively, a second main body (not shown) in which the three female terminals 6 and the female terminal box 19 are installed, and a second terminal housing portion 21 configured to have a second housing opening portion 20 to which the three female terminal opening portions 18 face respectively and simultaneously to house the female terminal boxes 19 and the second main body (not shown) into predetermined housing spaces respectively.

Further, the female terminal box 19 is made from resin, in which three housing spaces are formed so that the respective three female terminals 6 can be housed. Namely, anything can be used as the female terminal box in the embodiment if it is configured to have a plurality of housing spaces for housing the female terminals.

Further, the female terminals 6 are connected to electric wires 22 at the one end portions thereof. The electric wires 22 have excellent heat resistance and oil resistance, and for example, are configured to have a center conductor (copper or aluminum), an insulator (cross-linked polyethylene), a shield, and a seal in this order. Further, the main body of the female terminal 6 is formed so as to have a box-like shape and includes the holding means for holding the male terminals 5 from above and below in the internal portions thereof.

Figure 10:
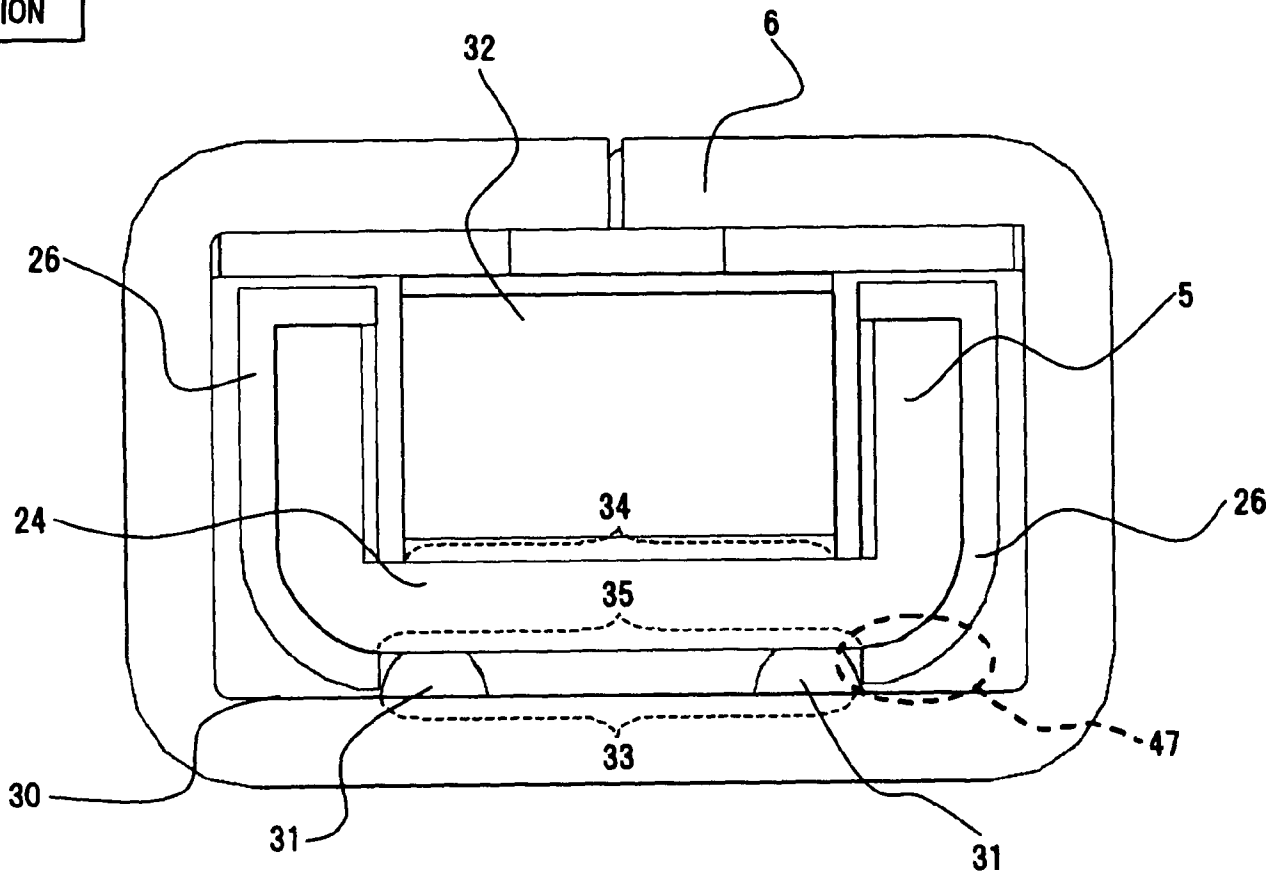
FIG. 10 is an explanatory view schematically showing a state that the male terminal is sandwiched from above and below by a holding means of the female terminal in the connector of the first embodiment according to the invention.
Figure 11:
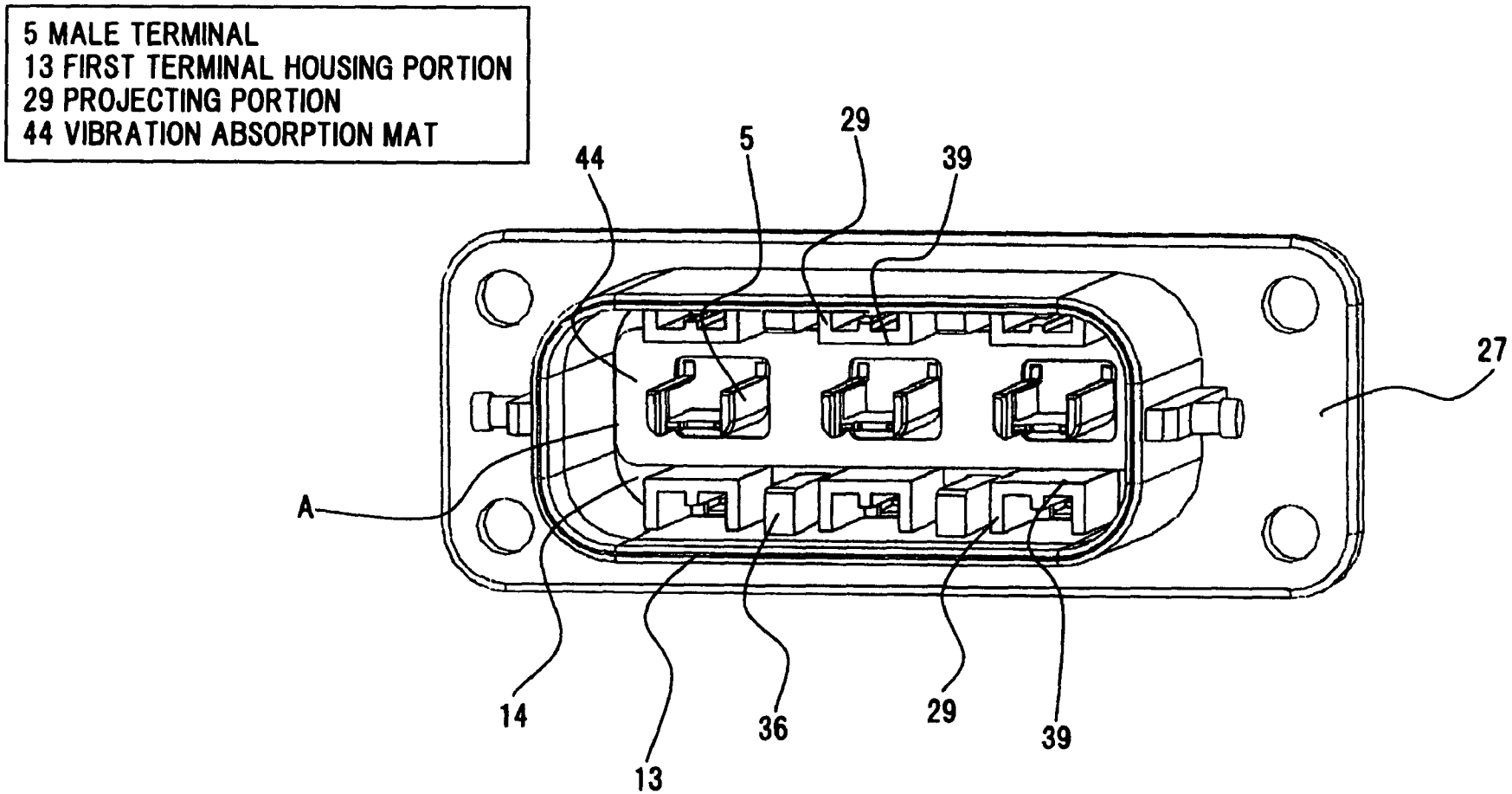
FIG. 11 is an explanatory view schematically showing the inside of the first terminal housing of the male connector portion in the connector of the second embodiment according to the invention.
Figure 12:
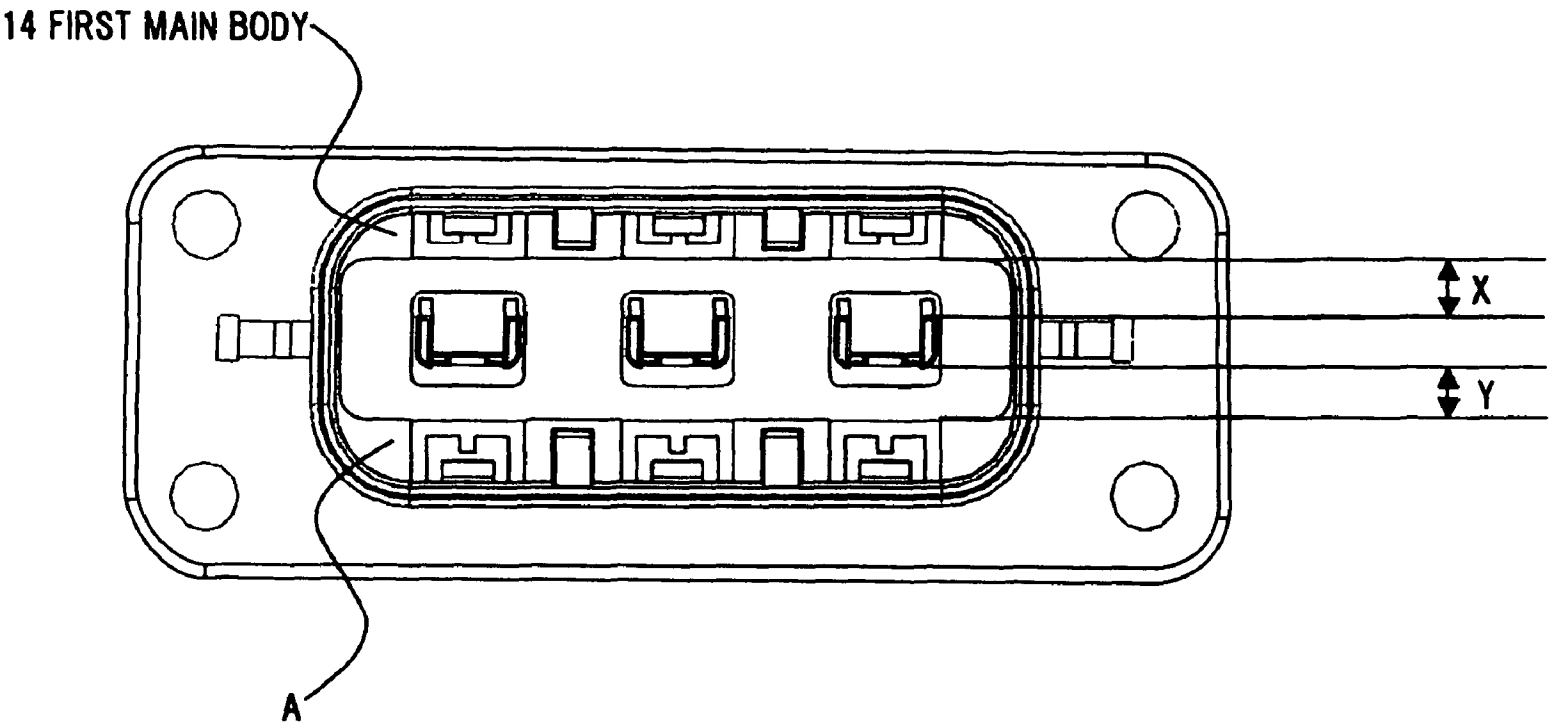
FIG. 12 is a front view schematically showing the inside of the first terminal housing of the male connector portion in the connector of the second embodiment according to the invention.

As shown in FIG. 10, the holding means is formed on the bottom surface portions 30 located on the inner side of the female terminal 6, and are configured to have dimple portions 33 including protrusions 31 and a spring portion 32 to press the male terminal 5 from above to the bottom portion 24. Namely, the holding means contacts the top and bottom surfaces of the male terminal 5 by the protrusions 31 of the dimple portions 33 and the spring portion 32 so that the holding means holds the male terminals 5 from above and below. Further, electrical conduction between the male terminal 5 and the female terminal 6 is achieved by the contact between the protrusions 31 of the dimple portions 33 and the bottom portion 24 of the male terminal 5.

In the present application, as to the male terminal 5, "part contacting the holding means when the male terminal is inserted into the female terminal" means, as shown in FIG. 10, the top surface and/or bottom surface of the bottom portion 24 of the male terminal 5, i.e., a dimple side contact surface 35 of the male terminal 5 contacting the dimple portion 33, and/or a spring side contact surface 34 of the male terminal 5 contacting the spring portion 32 in the bottom portion 24 of the male terminal 5.

Further, as shown in FIG. 10, in a state that the rubber cap 26 is applied to the male terminal 5, the height of the protrusions 31 is adjusted so as to prevent a lower end portion 47 of the rubber cap 26 covering the lower portion of the sidewall portion 23 of the male terminal 5 from contacting the bottom surface portion 30 of the female terminal 6.

Further, the second terminal housing portion 21 is made of metal, for example, aluminum. Furthermore, a relationship between the above-mentioned first terminal housing portion 13 and the second terminal housing portion 21 corresponds to the relationship between male and female, and in the first embodiment, the first terminal housing portion 13 corresponds to a male terminal housing portion and the second terminal housing portion 21 corresponds to a female terminal housing portion.

Second Embodiment

Hereinafter, a connector according to a second embodiment will be explained with reference to FIGS. 11 to 14.

The connector in the second embodiment according to the invention, has a lot of the same portions as those of the above-mentioned connector 2 according to the first embodiment so that only differences from the connector 2 will be explained. Further, the same reference numbers as those of the connector 2 according to the first embodiment will be used throughout the drawings according to the second embodiment shown in FIGS. 11 to 14 and the following detailed description to refer to the same or like parts.

The differences between the connector in the second embodiment according to the invention and the above-mentioned connector 2 according to the first embodiment are as described below.

Figure 13:
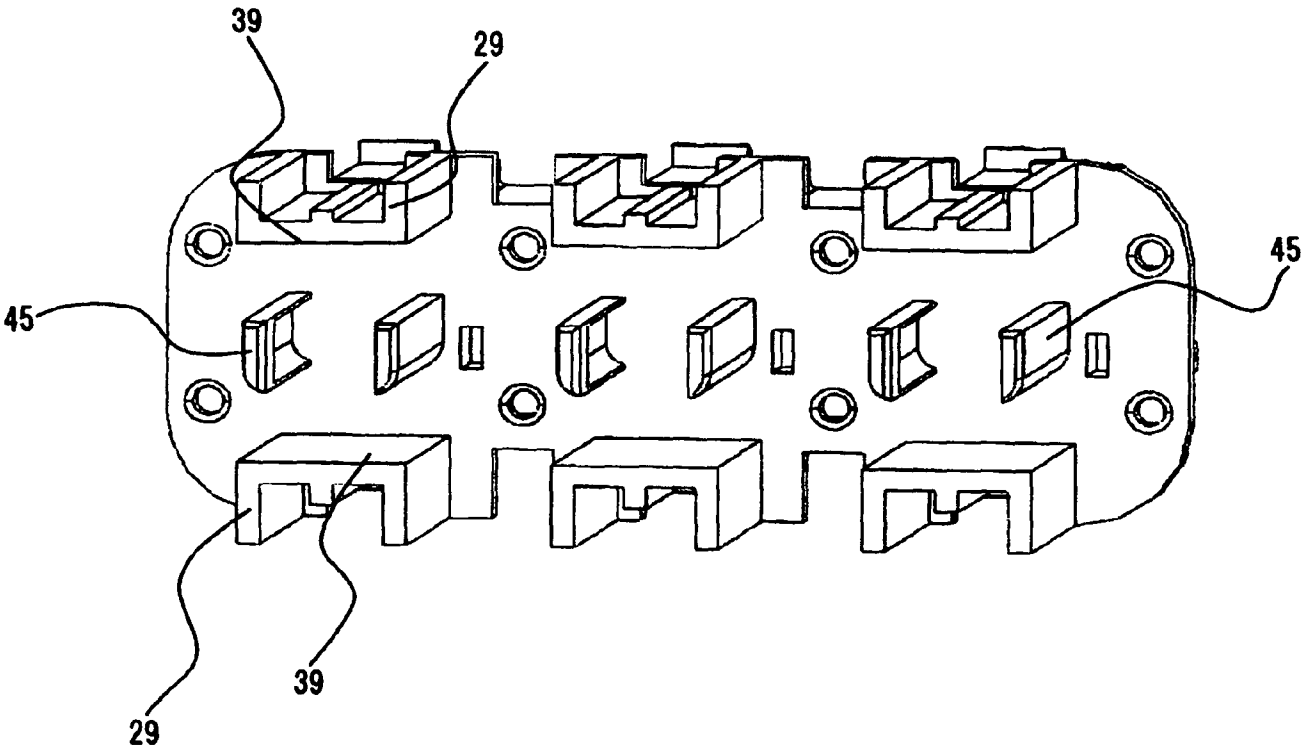
FIG. 13 is a perspective view schematically showing a first main body in the connector of the second embodiment according to the invention.

First, as shown in FIG. 13, instead of the rubber cap 26, cover portions 45 are simultaneously formed as parts corresponding to the rubber caps 26 at the time of the insert molding of the first main body 14. Further, in FIG. 13, the male terminals 5 are omitted. Due to this, the operation of applying the rubber cap 26 becomes unnecessary so that the fabrication efficiency can be enhanced. Further, the cover portion 45 does not have such a pocket portion 41 that the rubber cap 26 has.

Figure 14:
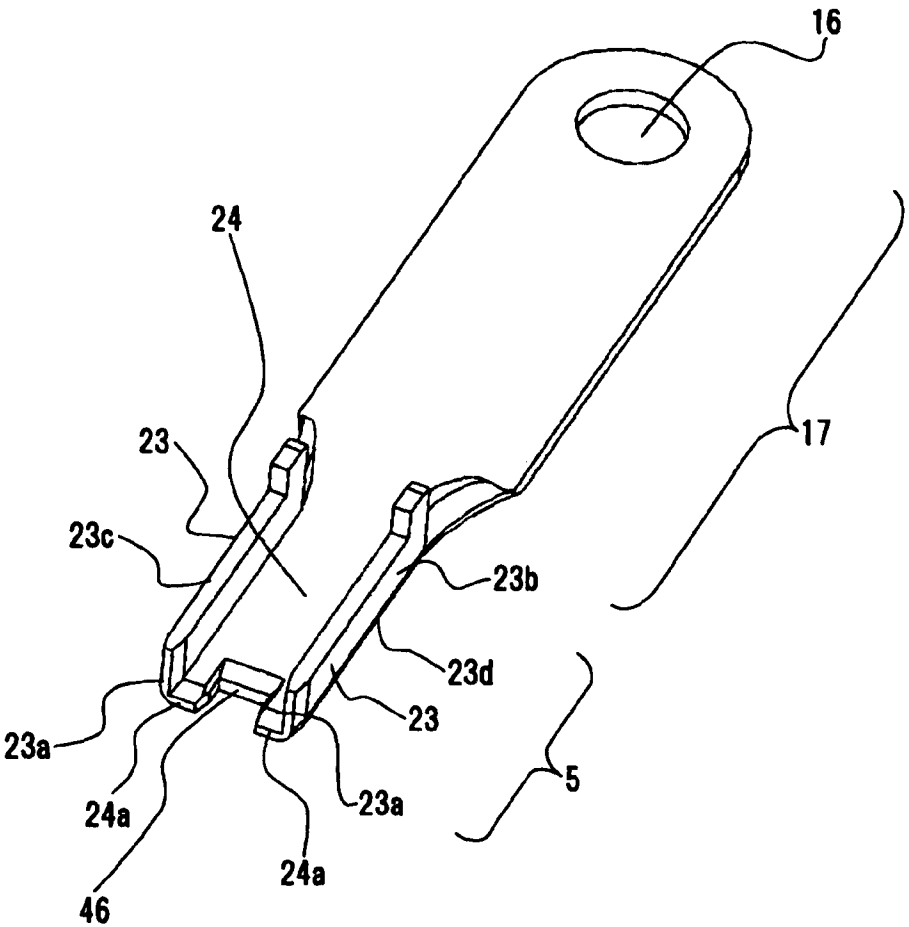
FIG. 14 is an explanatory view schematically showing that the male terminal and a device side male terminal are integrally formed in the connector of the second embodiment according to the invention.

Second, as shown in FIG. 14, the one end of the male terminal 5 does not have the structure that the sidewall portions are located in advance of the bottom portion 24. Namely, the reason is that if the insert molding is used the front surfaces 23*a* of the sidewall portions 23 of the male terminals 5 can be covered with an insulating resin having a predetermined thickness, even if the structure is not used that the sidewall portions 23 of the male terminal 5 are located in advance of the bottom portion as shown in FIG. 8. Consequently, if the male terminal 5 is covered with the resin, almost the same structure as that shown in FIGS. 6 and 7 can be obtained according to a side view.

Third, as shown in FIG. 14, a concave portion 46 is formed in almost the center of the end portion of the bottom portion 24 of the male terminal 5. Due to this, the shape of the front surface 24*a* can be adapted to shapes of the top ends of fingers so that it can further protect the bottom portion 24 of the male terminal 5 and the front surface 24*a* of the bottom portion 24 from being touched by hands, fingers and the like.

First Modification

In the first and second embodiments, the projecting portions 29 are installed so as to project in the predetermined housing space A of the first terminal housing portion 13, at the locations opposed to the parts contacting the holding means installed in the female terminal 6 when the male terminal 5 are inserted into the female terminal 6, and at a state of sandwiching the male terminal 5 from above and below, however, the following composition can be also used.

Namely, in the first and second embodiments, where the predetermined housing space A of the first terminal housing portion 13 is relatively large, the projecting portions 29 are installed so as to hold (or sandwich) the male terminal 5 from above and below, however, the width in the vertical direction of the first terminal housing portion 13 may be determined so as to omit one or both of the projecting portions 29. On the other hand, if one of the top surface and the bottom face of the male terminal 5 contacting the holding means is relatively distant from the first terminal housing portion 13 to provide a large housing space therebetween, the projecting portion 29 may be in the large housing space toward the male terminal 5 such that the top surface or the bottom face of the male terminal 5 contacting the holding means can be protected from being touched through the large housing space by the foreign body.

Also due to this, when the male terminals 5 are inserted into the female terminals 6, the top and bottom surfaces of the male terminal 5 which contact the holding means of the female terminal 6 can be protected from being touched by the foreign body.

Second Modification

In the first and second embodiments and the first modification, so-called "three polar type connector" is used, however, so-called "single polar type connector" can be also used.

Third Modification

In the first and second embodiments and the first and second modifications, the male terminal 5 is formed to have a roughly U-shaped cross-section, however, the other shapes (for example, linear shape) can be also used.

Fourth Modification

In the first and second embodiments and the first, second and third modifications of the embodiment, the projecting portions 29 are formed integrally with the first main body 14, however, they can be formed separately from the first main body 14 so as to be installed in the first main body 14. And, as a different aspect, the projecting portions 29 can be formed integrally with the first terminal housing portion 13 or separately from the first terminal housing portion 13 so as to be installed in the first terminal housing portion 13. Further, in the first and second embodiments and the first, second and third modifications of the embodiment, the engaging structure of the first main body 14 and the first terminal housing portion 13 (see FIGS. 5 to 7) can be achieved by inserting the first main body 14 into the first terminal housing portion 13 from the side of the first housing opening portion 15, however, in case of the above-mentioned different aspect, the engaging structure has to be changed. For example, the structures can be considered that the first main body 14 is inserted from the opposite opening of the first housing opening portion 15 or the opening area of the opposite opening of the first housing opening portion 15 is reduced in view of the projecting portions 29.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A connector, comprising:

a male connector part comprising a male terminal, a first main body to which the male terminal is attached, and a first terminal housing portion comprising a first housing opening portion in which an end of the male terminal is exhibited and a predetermined housing space in which the male terminal is housed;

a female connector part comprising a female terminal into which the male terminal is inserted, the male terminal being electrically connected to the female terminal by fitting the male connector part with the female connector part;

a holding means inside the female terminal for holding the male terminal in a vertical direction; and a touch protecting means inside the first terminal housing portion for protecting the male terminal housed in the predetermined housing space from being touched by a foreign body, wherein the touch protecting means comprises an insulating portion for covering a part of the male terminal including the end of the male terminal except a part contacting the holding means when the male terminal is inserted into the female terminal, and a pair of projecting portions projecting in the predetermined housing space of the first terminal housing portion and at a position opposite the part contacting the holding means when the male terminal is inserted into the female terminal such that the male terminal is sandwiched therebetween in the vertical direction.

2. The connector according to claim 1, wherein the insulating portion at the end of the male terminal projects a predetermined amount from the part contacting the holding means when the male terminal is inserted into the female terminal.

3. The connector according to claim 1, wherein the male terminal is nearly U-shaped in a cross section, and comprises a pair of sidewall portions and a bottom portion contacting the holding means, and the insulating portion covers a front surface, an outside surface, an upper surface and a bottom surface of the sidewall portions of the male terminal, and a front end of the pair of sidewall portions covered with the insulating portion projects a predetermined amount from a front end of the bottom portion.

4. The connector according to claim 3, wherein the bottom portion comprises a concave portion formed at an end portion thereof.

5. The connector according to claim 1, wherein the projecting portion has substantially a same width in a horizontal direction as that of the male terminal covered with the insulating portion.

6. A connector, comprising:

a male connector part comprising a male terminal, a first main body to which the male terminal is attached, and a first terminal housing portion comprising a first housing opening portion in which an end of the male terminal is exhibited and a predetermined housing space in which the male terminal is housed;

a female connector part comprising a female terminal into which the male terminal is inserted, the male terminal being electrically connected to the female terminal by fitting the male connector part with the female connector part;

a holding means inside the female terminal for holding the male terminals in a vertical direction; and a touch protecting means inside the first terminal housing portion for protecting the male terminal housed in the predetermined housing space from being touched by a foreign body, wherein the predetermined housing space has such a width in the vertical direction that a part of the male terminal contacting the holding means when the male terminal is inserted into the female terminal can be protected from being touched by the foreign body, and the touch protecting means comprises an insulating portion for covering a part of the male terminal including the end of the male terminal except the part contacting the holding means when the male terminal is inserted into the female terminal.

7. The connector according to claim 6, wherein the insulating portion at the end of the male terminal projects a predetermined amount from the part contacting the holding means when the male terminal is inserted into the female terminal.

8. The connector according to claim 6, wherein the male terminal is nearly U-shaped in a cross section, and comprises a pair of sidewall portions and a bottom portion contacting the holding means, and the insulating portion covers a front surface, an outside surface, an upper surface and a bottom surface of the sidewall portions of the male terminal, and a front end of the pair of sidewall portions covered with the insulating portion projects a predetermined amount from a front end of the bottom portion.

9. The connector according to claim 8, wherein the bottom portion comprises a concave portion formed at an end portion thereof.

10. A connector, comprising:

a male connector part comprising a male terminal, a first main body to which the male terminal is attached, and a first terminal housing portion comprising a first housing opening portion in which an end of the male terminal is exhibited and a predetermined housing space in which the male terminal is housed;

a female connector part comprising a female terminal into which the male terminal is inserted, the male terminal being electrically connected to the female terminal by fitting the male connector part with the female connector part;

a holding means inside the female terminal for holding the male terminals in a vertical direction; and a touch protecting means inside the first terminal housing portion for protecting the male terminal housed in the predetermined housing space from being touched by a foreign body, wherein the predetermined housing space has such a width in the vertical direction that a part of the male terminal contacting the holding means when the male terminal is inserted into the female terminal can be protected from being touched by the foreign body, the touch protecting means comprises an insulating portion for covering a part of the male terminal including the end of the male terminal except the part contacting the holding means when the male terminal is inserted into the female terminal, and the touch protecting means further comprises a projecting portion projecting in the predetermined housing space of the first terminal housing portion and at a position opposite the part contacting the holding means when the male terminal is inserted into the female terminal.

11. The connector according to claim 10, wherein the insulating portion at the end of the male terminal projects a predetermined amount from the part contacting the holding means when the male terminal is inserted into the female terminal.

12. The connector according to claim 10, wherein the male terminal is nearly U-shaped in a cross section, and comprises a pair of sidewall portions and a bottom portion contacting the holding means, and the insulating portion covers a front surface, an outside surface, an upper surface and a bottom surface of the sidewall portions of the male terminal, and a front end of the pair of sidewall portions covered with the insulating portion projects a predetermined amount from a front end of the bottom portion.

13. The connector according to claim 12, wherein the bottom portion comprises a concave portion formed at an end portion thereof.

14. The connector according to claim 10, wherein the projecting portion has substantially a same width in a horizontal direction as that of the male terminal covered with the insulating portion.

* * * * *